US006854806B2

(12) United States Patent
Huse

(10) Patent No.: US 6,854,806 B2
(45) Date of Patent: Feb. 15, 2005

(54) BLOW-MOLDED SEAT ASSEMBLY AND METHOD OF MAKING SAME

(75) Inventor: Ovie C. Huse, Arlington, TX (US)

(73) Assignee: Moeller Marine Products, Twinsburg, OH (US)

( * ) Notice: Subject to any disclaimer, the term of this patent is extended or adjusted under 35 U.S.C. 154(b) by 0 days.

(21) Appl. No.: 10/807,046

(22) Filed: Mar. 23, 2004

(65) Prior Publication Data

US 2004/0174062 A1 Sep. 9, 2004

Related U.S. Application Data

(60) Continuation of application No. 10/360,179, filed on Feb. 7, 2003, which is a division of application No. 09/732,673, filed on Dec. 8, 2000, now Pat. No. 6,536,844.

(51) Int. Cl.[7] ..... A47C 7/02

(52) U.S. Cl. ..... 297/452.65; 297/451.13; 297/DIG. 2

(58) Field of Search ..... 297/452.65, 451.13, 297/DIG. 2, 452.1, 451.11

(56) References Cited

U.S. PATENT DOCUMENTS

| | | | | | |
|---|---|---|---|---|---|
| 3,479,421 | A | | 11/1969 | Armbruster et al. | 264/98 |
| 3,556,595 | A | * | 1/1971 | Bartel | |
| 3,612,607 | A | * | 10/1971 | Lohr | |
| 3,705,931 | A | | 12/1972 | Confer et al. | 264/89 |
| 3,742,995 | A | | 7/1973 | Confer et al. | 150/5 |
| 3,841,704 | A | * | 10/1974 | Platner et al. | |
| 3,891,118 | A | | 6/1975 | Laurizio | 220/288 |
| 3,898,310 | A | | 8/1975 | Schiemann | 264/94 |
| 3,919,374 | A | | 11/1975 | Komendowski | 264/90 |
| 3,989,787 | A | | 11/1976 | Scott, Jr. et al. | 264/114 |
| 4,023,257 | A | | 5/1977 | Wright et al. | 29/460 |
| 4,207,284 | A | | 6/1980 | Speas | 264/516 |
| 4,215,089 | A | | 7/1980 | Uhlig et al. | 264/516 |
| 4,307,059 | A | | 12/1981 | Cambio | 264/516 |
| 4,323,411 | A | | 4/1982 | Uhlig | 156/245 |
| 4,332,419 | A | * | 6/1982 | Vogel | |
| 4,536,116 | A | | 8/1985 | Murray | 411/82 |
| 4,539,172 | A | | 9/1985 | Winchell et al. | 264/515 |
| 4,589,563 | A | | 5/1986 | Born | 220/3 |
| 4,880,276 | A | * | 11/1989 | Shovar | |
| 4,913,488 | A | * | 4/1990 | Donnell, Jr. | |
| 4,952,133 | A | | 8/1990 | Hasegawa et al. | 425/503 |
| 4,976,910 | A | | 12/1990 | Gatley et al. | 264/278 |
| 5,067,772 | A | * | 11/1991 | Koa | |
| 5,100,204 | A | * | 3/1992 | Makihara et al. | |
| 5,104,472 | A | | 4/1992 | Kasugai et al. | 156/245 |
| 5,219,205 | A | * | 6/1993 | Fourrey et al. | |
| 5,320,237 | A | | 6/1994 | Stolzman | 220/257 |
| 5,356,589 | A | | 10/1994 | Sugalski | 264/265 |
| 5,611,602 | A | * | 3/1997 | Brady | |
| 5,681,093 | A | * | 10/1997 | Pfister | |
| 5,819,978 | A | | 10/1998 | Hlebovy | 220/601 |
| 6,193,924 | B1 | | 2/2001 | Huse | 264/503 |
| 6,294,127 | B1 | | 9/2001 | Huse | 264/516 |
| 6,305,568 | B1 | | 10/2001 | Suzuki et al. | 220/562 |
| 6,415,941 | B1 | | 7/2002 | Huse | 220/562 |

FOREIGN PATENT DOCUMENTS

| | | | |
|---|---|---|---|
| FR | 2307641 | 12/1976 | B29F/1/10 |
| JP | 61123514 | 6/1986 | |
| JP | 62101420 | 5/1987 | |
| JP | 1202420 | 8/1989 | |

* cited by examiner

*Primary Examiner*—Milton Nelson, Jr.
(74) *Attorney, Agent, or Firm*—Howard & Howard

(57) ABSTRACT

A molded seat assembly comprises an insert having an upper and a lower surface, a peripheral edge, and a ridge disposed adjacent to the peripheral edge. A seat portion comprised of a plastic material is molded directly to the insert whereby the plastic material contacts the peripheral edge, the ridge, the upper surface melts or softens the peripheral edge, the ridge and the upper surface forming both a cohesive bond and a locking engagement between the seat portion and the insert.

14 Claims, 2 Drawing Sheets

BLOW-MOLDED SEAT ASSEMBLY AND METHOD OF MAKING SAME

The present application is a continuation application of U.S. patent application Ser. No. 10/360,179, filed Feb. 7, 2003, now U.S. Patent No. (N/A) which is a divisional application of U.S. patent application Ser. No. 09/732,673, filed Dec. 8, 2000, now U.S. Pat. No. 6,536,844.

TECHNICAL FIELD

The present invention generally relates to marine seat assemblies and, more specifically, to a blow-molded seat assembly having a molded-in mounting insert and method of making same. The method includes the step of molding a seat body over a portion of the insert.

BACKGROUND OF THE INVENTION

Traditionally, seating assemblies, such as marine seats, have been molded by a variety of techniques such as roto-molding and blow-molding. Roto-molded seats have been disfavored since metal fasteners are required to be held in place in the mold during the molding operation so that the molded assembly can later be aligned and attached to a fixture such as a seat support assembly. This technique adds to the complexity of the molding operation. Additionally, prior art molded seats have had an undue amount of flexibility which imparted abnormal feel and discomfort to the person sitting in the seat. Metal and plywood inserts have been used in order to reduce the flexibility of the prior art seats but have met with unacceptable results.

The prior art has been unable to produce a blow-molded seat assembly having a mounting insert integrally molded therein because the heat of the fluid plastic utilized for forming the seat body portion of the seating assembly, has caused deformation or warping of the mounting insert which creates alignment problems when attempting to use fasteners, such as screws, to attach the seat assembly to a base.

The prior art has not successfully addressed the problems set forth above for blow-molded seat assemblies. Thus, there has been a need for an improved blow-molded seat assembly which provides increased strength, rigidity, and reduced manufacturing expense. There has also been a need for an improved blow-molding method of manufacturing seat assemblies which provides for a mounting plate to be molded into the seat assembly without causing deformation of the mounting plate and without the subsequent alignment problems set forth above.

SUMMARY OF THE INVENTION

The improved seat assembly of the present invention provides a blow-molded seat assembly having increased rigidity and lower manufacturing costs than the prior art seat assemblies. The seat assembly includes an insert having an upper and lower surface, a peripheral edge, and a ridge disposed adjacent to the peripheral edge. A seat portion comprised of a plastic material is molded directly to the insert whereby both the edge and the ridge are deformed providing locking engagement between the insert and the seat assembly.

In a method according to the present invention, a seat body is molded over an insert leaving a portion of the insert partially embedded in the molded seat body. A mold is provided having an inner surface and an orifice, wherein the inner surface of the mold defines an outer surface of the seat body. An insert is disposed in the mold orifice with the portion of the insert to be embedded into the container body positioned in the mold. The insert includes at least one peripheral edge and at least one ridge disposed adjacent to the peripheral edge and in the preferred embodiment an aperture whose perimeter is defined by an edge and ridge. A fluid plastic material is introduced into the mold and forced against the inner surface of the mold, the peripheral edge of the insert, the ridge of the insert and in the preferred embodiment about the perimeter edge. The fluid plastic material softens or partially melts the peripheral edge and ridge of the insert. The peripheral edge is partially deformed forming a locking engagement between the seat body and the insert. The plastic material comprising the container body and the plastic material comprising the insert can also cohesively bond together providing a secure seal between the seat body and the insert. The ridge prevents the flow of the plastic material beyond the ridge thus preventing the fluid plastic material from deforming the insert. In the preferred embodiment, the edge of the aperture is also softened and partially melted to deform and form a locking engagement between the seat body and insert.

In a preferred embodiment, a blow-molding process is used to mold the seat assembly.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION

Figure 1:
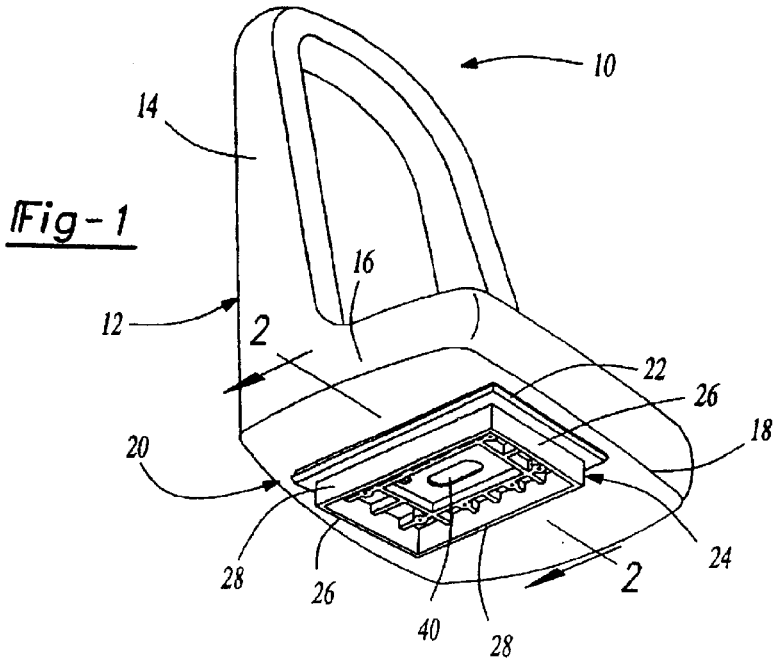
FIG. 1 is a perspective view of a seat assembly in accordance with the present invention.

Referring to FIG. 1, a seat assembly according to the present invention is generally shown at 10. The seat assembly 10 includes a seat body 12 which includes a wall 13 defining a seat back portion 14 and a seat bottom portion 16 having an underside 18. The seat body 12 is constructed of a plastic material, such as a thermoplastic, of the type known in the art, which is preferably made by a blow-molding process or other known processes. The plastic material which comprises the seat body 12 is preferably a high density linear polyethylene material having a general thickness of approximately 4–8 millimeters.

The seat assembly 10 also includes a mounting insert or plate 20 which is disposed on the underside 18 of the seat bottom portion 16. The mounting insert 20 is a prefabricated plastic piece constructed of, for example, an injection molded plastic material such as high-density polyethylene. For reasons set forth below, the seat body 12 and the mounting insert 20 preferably are made from the same plastic material. Typically, the mounting insert 20 will have a general thickness of approximately 4 to 8 millimeters.

The mounting insert 20 includes a flat attachment platform 22, a base portion 24 having ends 26 and sides 28. The mounting insert 20 also includes an upper surface 32 and a lower surface 34. The mounting insert 20 can have at least one portion embedded in the seat body 12 as described below.

Figure 2:
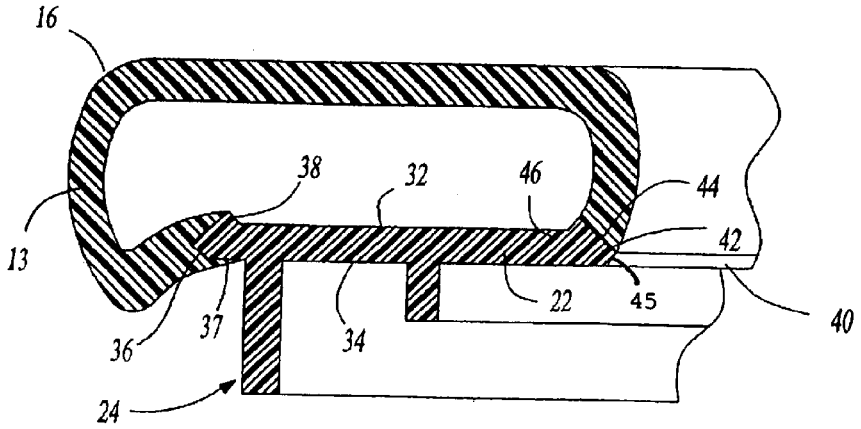
FIG. 2 is a cross-sectional view of the insert and seat body assembly taken along line 2—2 of FIG. 1.

Referring specifically to FIG. 2, the mounting insert 20 has a coextensive peripheral edge 36. The peripheral edge 36 has a substantially tapered cross-section. The peripheral edge 36 of the mounting insert 20 is partially embedded in the wall 13 of the seat body 12. That is, upon molding of the seat body 12, the fluid plastic material comprising the seat body 12 engulfs a portion of the peripheral edge 36. The plastic material which comprises the wall 13 of the seat body 12 substantially engulfs a bottom surface 37 of the peripheral edge 36 and substantially covers the upper surface 32 of the mounting insert 20.

The peripheral edge 36, the ridge 38, and the upper surface 32 of the insert 20 can also become partially cohesive with the outer surface 13 of the seat body 12. That is, if compatible plastic materials are utilized for both the insert 20 and the seat body 12, the materials comprising the respective parts can form a cohesive bond there between. Additionally, the peripheral edge 36 and the ridge 38 of the insert 20 can both be partially deformed by the hot plastic material forming the seat body 12 and can thus provide locking engagement between the insert 20 and the seat body 12. The deformed peripheral edge 36 and the deformed ridge 38 allow for a mechanical lock to be formed between the deformed peripheral edge 36 and the deformed ridge 38 having the plastic material forming the seat body 12 disposed there over.

Figure 3:
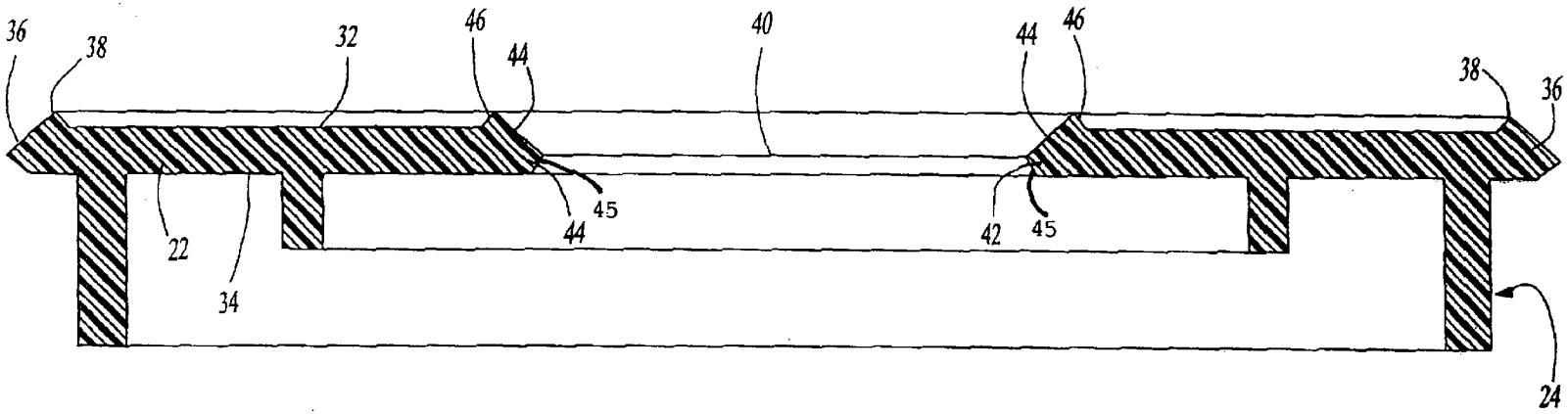
FIG. 3 is a cross-sectional view of the insert in accordance with the present invention.

Referring to FIGS. 2 and 3, in the preferred embodiment, the insert 20 can include at least one aperture 40 disposed therein. As is shown in the Figures, the aperture 40 preferably includes an internal edge 42 having a top surface 44 and a bottom surface 45. The internal edge 42 extends substantially continuously about the aperture 40. The aperture can also include an upwardly extending ridge 46 which continuously extends about the aperture 40.

As discussed above, the internal edge 42 has a substantially tapered cross-section. The internal edge 42 and the ridge 46 are substantially embedded in the wall 13 of the seat body 12. Upon molding of the seat body 12, the plastic material forming the seat body 12 engulfs the internal edge 42 and the ridge 46. The plastic material which forms the wall 13 substantially engulfs both the top surface 44 and the bottom surface 45 of the internal edge 42 and also contacts the ridge 46.

The internal edge 42 of the insert 20 can also become partially cohesive with the wall 13 of the seat body 12. That is, as described above, the materials comprising the respective parts can form a cohesive bond there between. Additionally, both the internal edge 42 and the ridge 46 can be partially deformed by the hot plastic material forming the seat body 12 and can thus provide locking engagement between the insert 20 and the seat body 12. The deformed internal edge 42 and the deformed ridge 46 allow for a mechanical lock to be formed between the deformed internal edge 42 and the deformed ridge 46 having the material comprising the seat body 12 disposed there over.

In the method of making the molded seat assembly 10 in accordance with the present invention, the insert 20 is disposed into a mold. The insert 20 is disposed in an orifice of the mold having an inner surface which defines the outer surface of the seat body. A hot fluid plastic material is simultaneously disposed over both the inner surface of the mold, the peripheral edge 36 and an inner edge 42 of the insert 20. This step can be performed, for example, by any plastic molding method which is well known in the art. The preferred plastic molding method is blow-molding. The hot fluid plastic material contacts the peripheral edge 36 and inner edge 42 of the insert 20 and can begin to soften or even melt at least a portion of the peripheral edge 36 and edge 42.

The blow-molding process generally involves the molding of a hollow tube or parison of molten plastic that is lowered from an extrusion head into a position within the mold. Pressurized gas or air is then injected into the parison. The increase in air pressure within the parison caused by the injection forces the walls of the parison into the contours of the inner surface of the mold, thereby forming the parison into a desired shape.

After the formed seat assembly 10 is removed from the mold, while it is still somewhat malleable, the insert 20 is placed over a mandrel or form and is loaded or stressed in order to remove any bends or deformation in the insert 20 caused by heat and then the seat assembly 10 is placed in a cooling bath.

The fluid plastic material cools and hardens forming the seat body 12. As the fluid plastic material cools, limited shrinkage of the plastic material can occur, drawing together the peripheral edge 36 and the seat body 12. The peripheral edge 36 and the ridge 38, the edge 42, and the ridge 46 can be deformed, thereby producing locking engagement with the seat body 12. Additionally, as discussed above, cohesive bonding between the peripheral edge 36, the ridge 38, the edge 42, and the ridge 46 and the fluid plastic material forming the seat body 12 can also occur.

The resultant seat assembly 10 has increased rigidity and is lighter in weight than prior art seat assemblies.

A preferred description of this invention has been disclosed; however, one of ordinary skill in the art would recognize that certain modifications would come within the scope of this invention. For that reason, the following claims should be studied in order to determine the true scope and content of this invention.

What is claimed is:

1. A molded seat assembly comprising:

an insert having an upper and a lower surface, a peripheral edge, and a ridge disposed adjacent to said peripheral edge, the peripheral edge having a substantially tapered cross-section and being angled with respect to the lower surface, said ridge extends upwardly from said upper surface of said insert; and a seat portion comprised of a plastic material molded directly to said insert, the seat portion substantially engulfing the peripheral edge up to said ridge.

2. A molded seat assembly as set forth in claim 1, wherein said ridge continuously extends about said insert.

3. A molded seat assembly as set forth in claim 1, wherein said peripheral edge is partially embedded in said seat portion.

4. A molded seat assembly as set forth in claim 3, wherein said peripheral edge is partially cohesive with said seat portion.

5. A molded seat assembly as set forth in claim 3, wherein said peripheral edge is partially deformed by and is partially embedded in the plastic material to provide locking engagement between said insert and said seat portion.

6. A molded seat assembly as set forth in claim 1, wherein said insert comprises an injection molded plastic material.

7. A molded seat assembly as set forth in claim 6, wherein the plastic material comprising said insert is polyethylene.

8. A molded seat assembly as set forth in claim 1, wherein the plastic material comprising said seat portion is polyethylene.

9. A molded seat assembly as set forth in claim 1, wherein said insert further includes an attachment platform defining said upper and lower surfaces and further defining at least one aperture therethrough.

10. A molded seat assembly as set forth in claim 9, wherein said at least one aperture includes a ridge, said ridge continuously extending about said aperture.

11. A molded seat assembly as set forth in claim 10, wherein said ridge extends upwardly from said top surface of said insert.

12. A molded seat assembly as set forth in claim 9, wherein said aperture includes an internal edge, said internal edge being partially embedded in said seat portion.

13. A molded seat assembly as set forth in claim 12, wherein said internal edge is partially cohesive with said seat portion.

14. A molded seat assembly as set forth in claim 12, wherein said internal edge is partially deformed by and is partially embedded in the plastic material to provide locking engagement between said insert and said seat portion.

* * * * *